United States Patent [19]

Hanyu

[11] Patent Number: 4,938,158

[45] Date of Patent: Jul. 3, 1990

[54] LOWER THREAD SUPPLYING MECHANISM FOR A SEWING MACHINE

[75] Inventor: Susumu Hanyu, Tokyo, Japan

[73] Assignee: Janome Sewing Machine Industry Co., Ltd., Tokyo, Japan

[21] Appl. No.: 307,388

[22] Filed: Feb. 6, 1989

[30] Foreign Application Priority Data

Feb. 5, 1988 [JP] Japan ..... 63-13600[U]

[51] Int. Cl.[5] ..... D05B 57/00; D05B 57/26

[52] U.S. Cl. ..... 112/184; 112/243; 112/255

[58] Field of Search ..... 112/255, 184, 467, 243, 112/242

[56] References Cited

U.S. PATENT DOCUMENTS

| | | | |
|---|---|---|---|
| 4,340,003 | 7/1982 | Hanyu et al. | 112/184 |
| 4,437,421 | 3/1984 | Johnson | 112/467 |
| 4,466,368 | 8/1984 | Hanyu et al. | 112/184 |
| 4,693,193 | 9/1987 | Hanyu et al. | 112/184 X |
| 4,700,644 | 10/1987 | Eguchi et al. | 112/255 |

*Primary Examiner*—Andrew M. Falik
*Attorney, Agent, or Firm*—Klein & Vibber

[57] ABSTRACT

A sewing machine having a vertically reciprocating needle carrying an upper thread, a needle plate secured to a sewing machine housing and provided with a needle penetrating hole, a loop-taker arranged below the needle plate and operated in synchronism with reciprocation of the needle for interlocking a lower thread carried thereby with the upper thread, and a feed dog for feeding a fabric placed on the needle plate in a predetermined direction on which a stitch composed of the interlocked upper and lower threads has been formed. A swingable arm is operated to interfere with the normal travelling path of the lower thread between the loop-taker and the needle hole to draw a predetermined amount of the lower thread out of the loop-taker, while the fabric is not being fed. A lower thread arresting barlike member cooperates with the lower thread drawing arm for preventing the lower thread from being pulled back from the stitch formed on the fabric, while the lower thread is being drawn out of the loop-taker device by the lower thread drawing arm.

8 Claims, 12 Drawing Sheets

LOWER THREAD SUPPLYING MECHANISM FOR A SEWING MACHINE

BACKGROUND OF THE INVENTION

This invention relates to a sewing machine in general and more particularly to a lower thread supplying mechanism in a sewing machine.

With the conventional sewing machines, a stitch is formed on a fabric by interlocking an upper thread carried by a vertically reciprocating needle and a lower thread wound around a bobbin contained in a loop-taker. The loop-taker is mounted below a needle plate having a needle penetrating hole and operated in synchronism with reciprocation of the needle to interlock the upper thread with the lower thread in a well known manner.

There has been proposed a lower thread drawing means arranged substantially on the travelling path of the lower thread between the bobbin and the needle hole. The said means is operated in synchronism with the loop-taker and includes a bar-like member adapted to move up and down whereby a predetermined amount of the lower thread is drawn out of the bobbin during the downward movement of the bar-like member, against a biasing force of a lower thread tension spring attached to the bobbin. The lower thread drawing operation is effected while the fabric is not being fed. The lower thread which has thus been pulled by the bar-like member will be supplied to the fabric as the fabric is being fed for the subsequent stitching operation.

Disadvantageously, such prior art arrangement will have a tendency to pull back the lower thread which has been interlocked with the upper thread to form a stitch on the fabric, resulting in shrinkage or crumpling of the stitch, as well as failure to supply a predetermined amount of the lower thread. This tendency will be increased as the lower thread tension spring is adjusted to have a greater biasing force to the lower thread which is just draw out of the bobbin.

SUMMARY OF THE INVENTION

It is therefore an object of the invention to provide a novel lower thread supplying mechanism capable of eliminating the disadvantages which have been encountered in the prior art.

Another object of the invention is to provide a lower thread arresting means cooperated with a lower thread drawing means for preventing that a lower thread being pulled back from the stitch having been formed on a fabric.

According to an aspect of the invention there is provided a lower thread supplying mechanism used in combination with a sewing machine having a vertically reciprocating needle carrying an upper thread, a needle plate secured to a sewing machine housing and provided with a needle penetrating hole, a loop-taker means arranged below the needle plate and operated in synchronism with reciprocation of the needle for interlocking a lower thread carried thereby with the upper thread, and a fabric feeding means for feeding a fabric placed on the needle plate in a predetermined direction on which a stitch composed of the interlocked upper and lower threads has been formed. The lower thread supplying mechanism comprises a lower thread drawing means for drawing a predetermined amount of the lower thread out of the loop taker means, and a lower thread arresting means cooperated with the lower thread drawing means for preventing the lower thread from being pulled back from the stitch formed on the fabric while the lower thread is being drawn out of the loop-taker means by the lower thread drawing means.

BRIEF DESCRIPTION OF ACCOMPANYING DRAWINGS

Further objects and advantages of the invention can be understood from the following detailed description when read in conjunction with the accompanying drawings in which.

DESCRIPTION OF PREFERRED EMBODIMENTS

Figure 13:
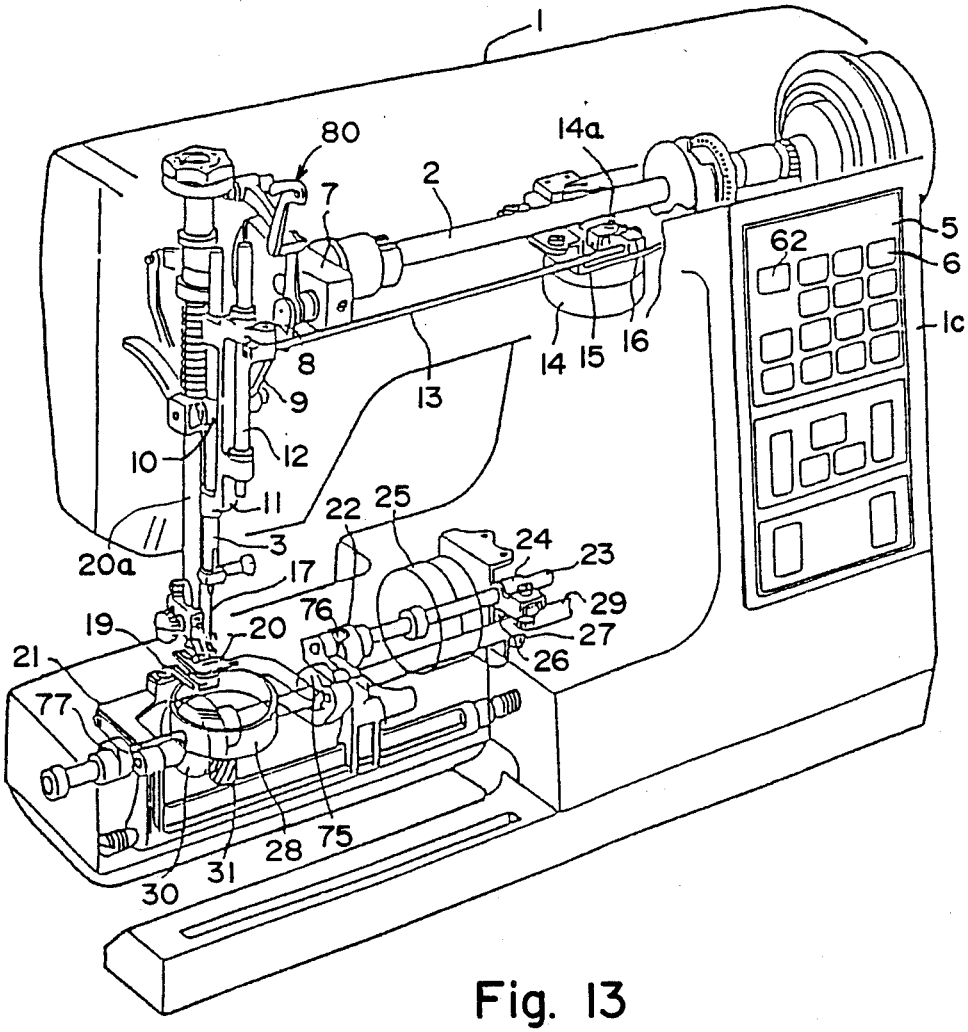
FIG. 13 is an elevated view showing an overall construction of an electronic sewing machine to which the lower thread supplying mechanism of the invention is applied.
Figure 20:
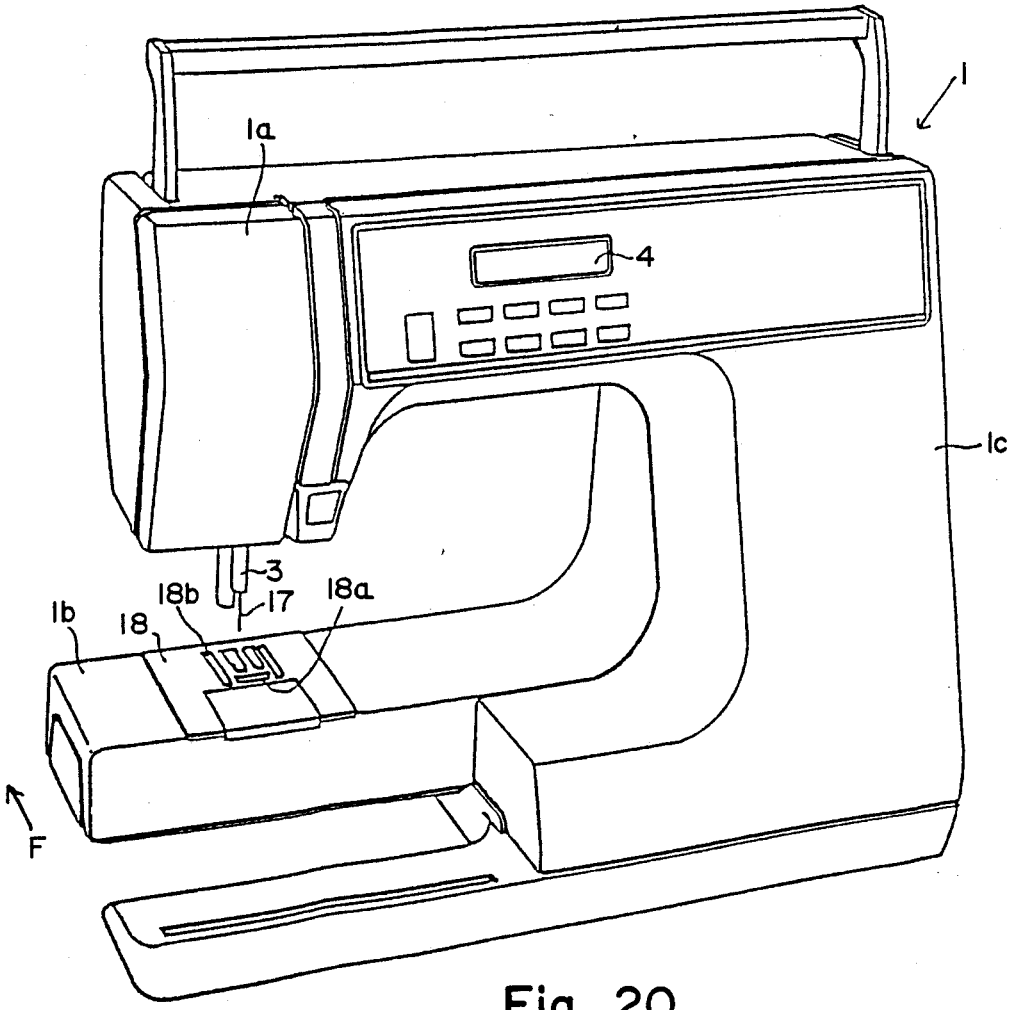
FIG. 20 is an elevated view showing an appearance of the sewing machine.

At first, a general appearance and construction of an electronic sewing machine embodying the invention will be described in reference to FIGS. 13 and 20. As shown, a needle bar 3 is supported by an arm 1*a* of a machine housing 1 and provided at the tip end with a needle 17 carrying a needle thread or an upper thread (not shown). The needle bar 3 is adapted to be vertically reciprocated and also swingable in a direction perpendicular to a fabric feeding direction F indicated by an arrow. A bed 1*b* extends substantially in parallel with the arm 1*a*, on which a needle plate 18 is attached in opposition to the needle 17. The needle plate 18 includes a needle hole 18*a* for allowing the needle 17 to pass therethrough. Below the needle plate 18 there is provided a loop-taker means 28 to be described later in detail, which is driven to rotate in synchronism with reciprocation of the needle 17 for interlocking the upper and lower threads to form a stitch on the fabric in a conventional manner. The needle plate 18 is also provided with a pair of elongated grooves 18*b* through which a feed dog 19 may be exposed and elevated to above the needle plate 18.

The needle bar 3 is connected to a main drive shaft 2 which is in turn connected to a drive source (not shown) and extend substantially horizontally within the arm 1*a*. The rotation of the main drive shaft 2 is duly transmitted to the needle bar 3 through a known crank mechanism. More particularly, a crank arm 7 is secured to one end of the main drive shaft 2 and rotated therotogether. A crank rod 9 is rotatably connected between a crank pin 8 secured near a peripheral edge of the crank arm 7 and a vertically extending rod 10 fixed to and supported by a needle bar holder 11. The needle bar 3 is secured to the lower end of the holder 11. The holder 11 is slideably supported by a stationary bar 12 secured to the sewing machine arm 1*a*. With the construction described above, during one rotation of the main drive shaft 2, the needle bar 3 at the upper dead point is moved down to the lower dead point and then elevated and returned to the upper dead point. Also, the needle bar 3 is swingable within a predetermined amplitude along with reciprocation of a horizontally extending rod 13 connected between the holder 11 and a link 16. The link 16 is secured to an arm 15 which is caused to swing by gear engagement with an output shaft 14*a* of a stepping motor 14 mounted in the machine housing 1. Such arrangement for swinging the needle 17 is well known and will therefore not need to be described in detail.

The feed dog 19 for shifting the fabric in the direction F is secured to an arm 21 driven by the main drive shaft 2. A cam 76 secured to the lower drive shaft 29 is adapted to be in engagement with a groove 77 of an adjustor 22 secured to one end of a rotating shaft 23. To the other end of the shaft 23 is connected an arm 24. The arm 24 is, in turn, connected through a link 27 to a crank 26 secured to an output shaft of a stepping motor 25. Thus, the arm 21 is swung by operation of the stepping motor in response to the stitch control data for controlling the fabric feeding amount in each stitch. Another cam 77 is also secured to the lower drive shaft 29 for moving the feed dog 19 up and down.

The loop-taker 28 is mounted in the machine bed 1*b*. The rotation of the lower drive shaft 29 is duly transmitted to the loop-taker 28 via a gear 30 secured to the shaft 29 and a threaded shaft 31 of the loop-taker 28. A presser foot 20 is attached to the lower end of a presser bar 20*a*. As well known, the presser foot 20 cooperates with the feed dog 19 to feed the fabric in the direction F.

A display 4 is provided on a front side of the machine arm 1*a* for representing a stitch pattern to be produced and a pattern number thereof. A select panel 5 is provided on a front side of a neck portion 1*c* of the housing 1. The select panel 5 includes ten-key selecting buttons 6 operated to designate a selective one of the pattern numbers and a display portion 62 for representing the selected pattern number.

Figure 14:
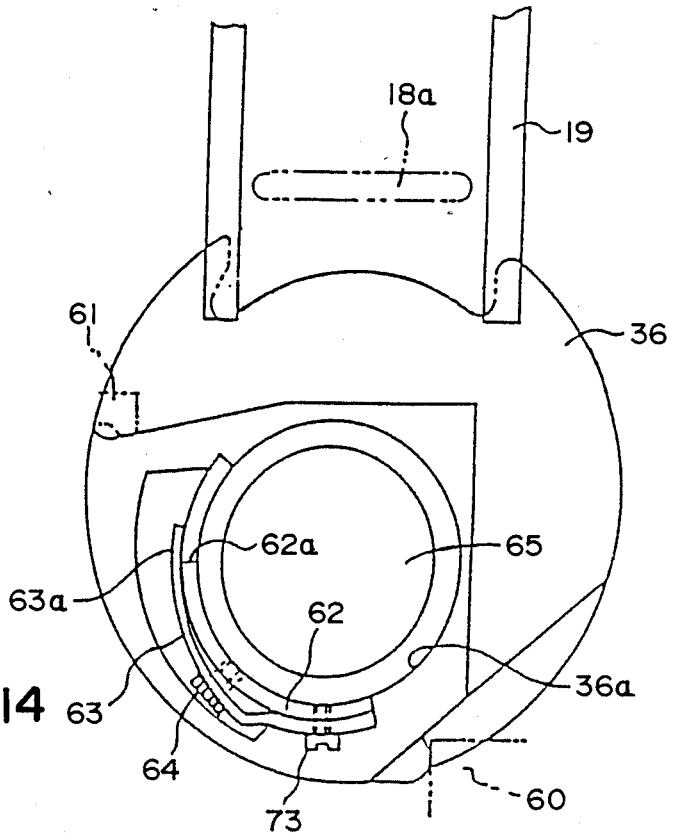
FIG. 14 is a plan view showing on an enlarged scale a loop-taker and components associated therewith used in the sewing machine.

Specifically referring to FIG. 14, a bobbin case 36 is received in the loop-taker 28. The bobbin case 36 is rotatable with respect to the loop-taker 28 and remains stationery due to engagement with stop member 60 and 61 secured to the machine housing 1. A lower thread 66 is wound around a bobbin 65 rotatably contained in the bobbin case 36 and may be drawn out through a slit 62*a* formed in an arcuate frame 62 attached to the outer periphery of the bobbin case 36. A leaf spring 63 is connected at its one end to the frame 62 by means of a fastening screw 73 so that the free end 63*a* comes in contact under pressure with the frame 63 around the slit 62*a*. Accordingly, the lower thread drawn through the slit 62*a* will be given a predetermined degree of tension by the spring 63. The lower thread tension may be adjusted by manipulation of an adjustment screw 64.

A lower thread 66 is drawn out of the bobbin 65 and supplied through the needle hole 18*a* to be interlocked with the upper thread carried by the needle 17. The mechanism for this purpose is particularly shown in FIG. 7 and FIG. 8. A vertically extending shaft 34, to which is secured the helical gear 31 adapted to be in engagement with the gear 30 of the lower drive shaft 29, is fixedly inserted into a central aperture of the bottom of the loop-taker 28. A partition wall 72 is secured to the bobbin case 36 in parallel with the peripheral wall 36*a*.

A lever 38 is rotatable about a rotational axis comprising a pair of pins 40 and 41 fixed with respect to the machine housing 1. The lever 38 includes a horizontally extending central bar section 38*a* which is adapted to draw the lower thread 66 out of the bobbin 65 in a manner described later. At one end of the central accomodating a pin 42*a* integrally formed at one end of a rod 42. The other end of the rod 42 is provided with an elongated opening 42*b* for displaceably receiving a pin 44*a* secured to a leading end of an operating arm 44. A spring 45 is connected between a projecting pin 42*c* of the rod 42 and the pin 44*a* of the operating arm 44 so that the pin 44*a* is normally biased upwardly to be positioned at the upper extreme end of the elongated opening 42*b* as particularly shown in FIG. 7.

Figure 21:
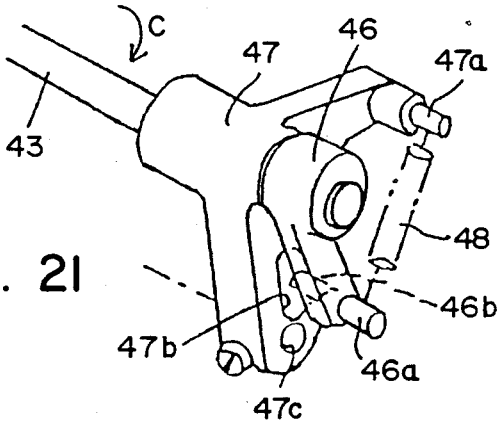
FIG. 21 is an elevated view on an enlarged scale showing a link mechanism of the lower thread drawing means of FIG. 7.

The operating arm 44 is secured at the other end thereof to a shaft 43 which is rotatable but not displaceable in any direction. A first link 46 is fixedly connected to the other end of the shaft 43. A second link 47 is also connected to the shaft 43 in close vicinity to the first link 46 but rotatable around the shaft 43. No axial movement of the second link 47 is permitted. As particularly seen in FIG. 21, the second link 47 has an aperture 47*b* for loosely accomodating a projection 46*b* of the first link 46. A spring 48 is connected between a projecting pin 47*a* located at a distance from the aperture 47*b* and a projecting pin 46*a* of the first link 46 so that the in contact with the leftside wall of the aperture 47*b*.

There is formed a hole 47*c* at one end of the second link 47 for receiving a shaft 50*a* of a headed pin 50. The pin 50 is fixed to the second link 47 by means of a fastening screw 47*d* and is rotatably connected to one end of a link arm 49. Thus, the link arm 49 is supported to the second link 47 and rotatable about the shaft 50*a* of the pin 50. A pin 49*a* is planted on the other end of the link arm 49 and a square piece 51 is fixed to the free end of the pin 49*a*. Reference numeral 56 represents a stepping motor mounted within the machine bed 1*b*. A gear 57 is rotated with an output shaft 56*a* of the stepping motor 56 and adapted to be in engagement with tooth 53*b* of a sector gear 53 which is rotatably supported within the machine bed 1*b* about a rotational axis 53*a*. To the axis 53*a* is secured an adjustor 55 provided with an arcuate groove 55*a* adapted to accomodate the square piece 51.

A cam 58 is secured to the other end of the lower drive shaft 29. A spring 59 is connected between the free end 49*b* of the link arm 49 and the machine housing 1 to normally bias the link arm 49 upwardly. With this arrangement, the link arm 49 is always in contact with the outer periphery of the cam 58 and swinging about the shaft 50*a* in dependence upon the cam position which will vary during rotation of the lower drive shaft 29.

Figure 9:
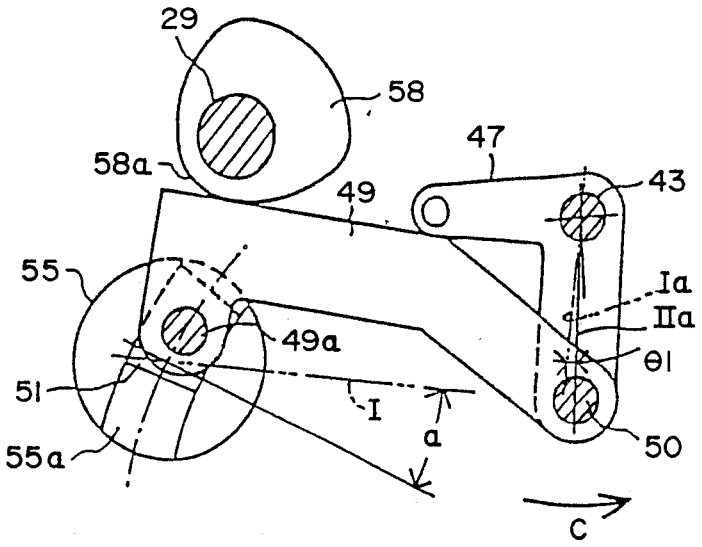
FIG. 9 and FIG. 10 are explanatory views showing operation of the lower thread drawing means each figure illustrating a different phase of the main drive shaft.
Figure 10:
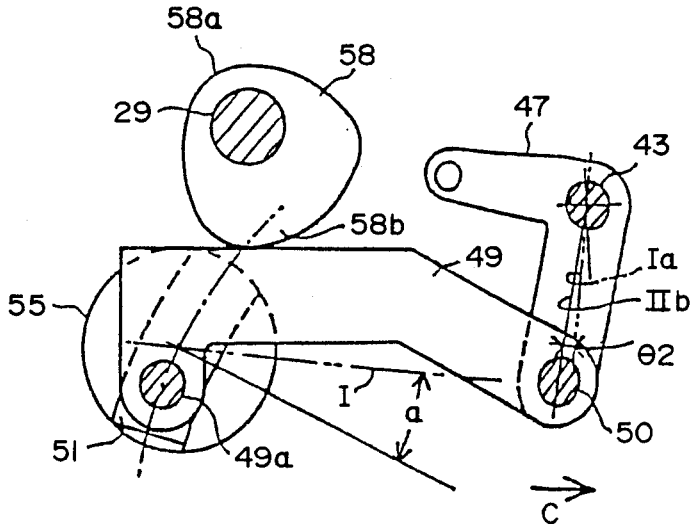

Provided that the rotational angle of the main drive shaft 2 will be 0° when the needle 17 is positioned at the upper dead point, when the rotational angle of the main drive shaft is 260° at which time the needle 17 is on the way to ascend from the lower dead point, positional relationship in the link mechanism is diagrammatically illustrated in FIG. 9, which will be changed to that shown in FIG. 10 in the case of the rotational angle 0°. In these figures, the arcuate groove 55*a* of the adjustor 55 will be inclined by $\alpha°$ with respect to the neutral position (1) wherein the arcuate groove 55*a* traces just along a circle having the center of the shaft 50.

Figure 11:
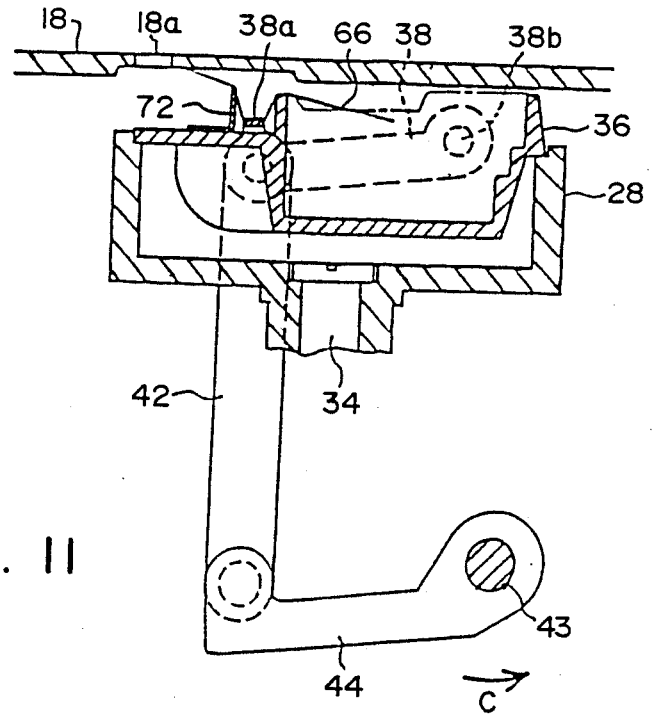
FIG. 11 and FIG. 12 are cross-sectional explanatory views showing operation of the lower thread drawing means at the different two phases corresponding to those shown in FIG. 9 and FIG. 10 respectively.

In FIG. 9, at the rotational angle 260° of the main drive shaft 2, the link arm 49 is in contact with the smallest-diameter portion 58*a* of the cam 58 so that the square piece 51 is received in the arcuate groove 55*a* at the upper extreme position thereof. In this case, the second link 47 has been rotated about the lower drive shaft 43 in the direction C to the greatest angular position (1*a*). More particularly, in comparison with the case wherein the square piece 55*a* is received just in the middle of the arcuate groove 55*a* defining the neutral line (IIa), the second link 47 is inclined by an angle ($\theta_1$) and difines the inclined line (IIa). Accordingly, the lower drive shaft 43 is also caused to rotate in the direction C by the same angle ($\theta_1$). The rod 44 secured to the lower drive shaft 43 will then pull the rod 42 down through engagement between the pin 44*a* and the elongated opening 42*b*, thereby lowering the center bar section 38*a* of the lower thread supplying lever 38. Accordingly, as shown in FIG. 11, the lower thread 66 is pulled down by the lever 38 between the partition wall 72 and the bobbin case wall 36*a*, whereby some amount of the lower thread 66 is drawn out of the bobbin 65, against the spring force exerted by the lower thread tension spring 63.

The lowering amount of the center bar section 38*a*, which governs the amount of the lower thread 66 drawn out of the bobbin 65, will be dependence upon the inclination angle $\alpha°$ of the adjustor 55. The inclination angle $\alpha°$ can be adjusted by operation of the stepping motor 56 in response to the stitch control data in each stitch.

Figure 12:
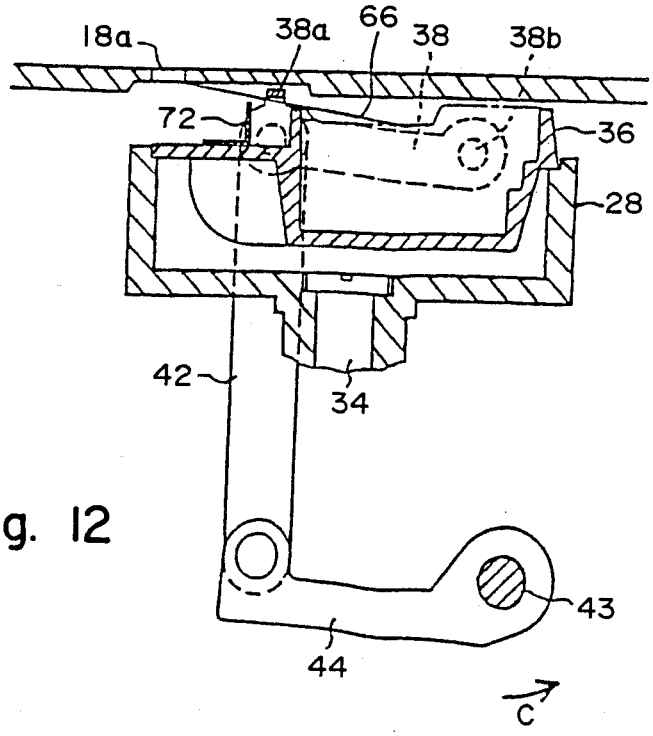

When the main drive shaft 2 is further rotated to come into the rotational position of the angle 0° which is shown in FIG. 10, the link arm 49 will now come into contact with the largest-diameter portion 58*b* of the cam 58. The square piece 51 is received in the arcuate groove 55*a* at the lower extreme position thereof, thereby pulling the link arm 49 back to the left and rotating the second link 47 in a clockwise direction, that is opposite to the direction C, by an angle ($\theta_2$). The second link 47 extends along the line (IIb). In this case, as shown in FIG. 12, the center bar section 38*a* is in a retracted position and free from contact with the lower thread 66. Cyclic operation of the center bar section 38*a* depending upon rotation of the drive shaft 29 is clearly shown in FIG. 19.

Figure 7:
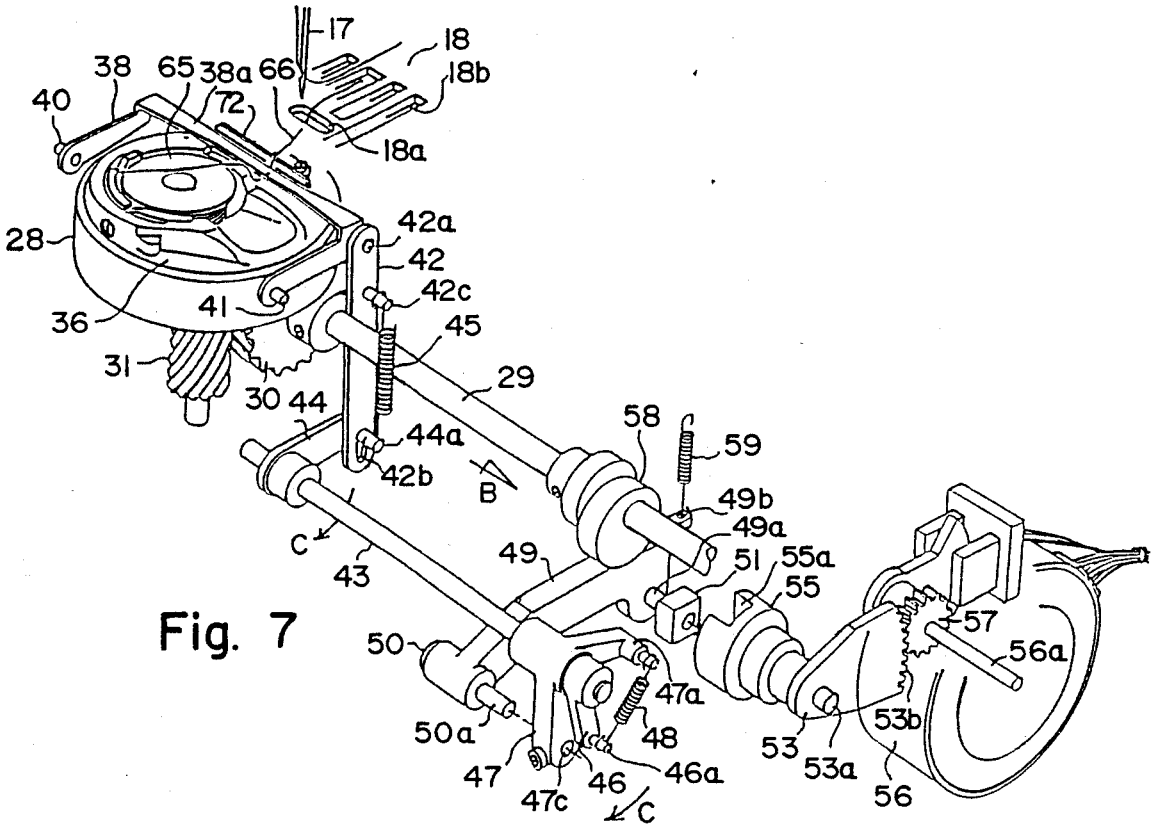
FIG. 7 is an elevated view showing in particular the lower thread drawing means of the supplying mechanism, from which the lower thread arresting means of the supplying mechanism is omitted.
Figure 8:
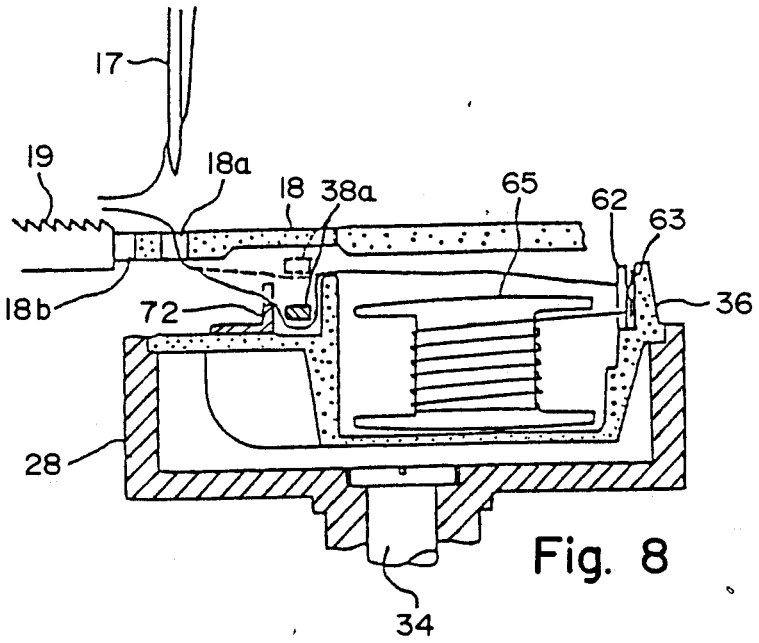
FIG. 8 is a cross section of a part of the lower thread drawing means shown in FIG. 7.

The above-described mechanism shown in FIG. 7 and FIG. 8 and its operation demonstrated in FIG. 9 through FIG. 12 and FIG. 19 will be substantially identical to the prior art. The characteristic features of the present invention will now be described in reference to FIG. 1 through FIG. 6, which relates particularly to a resistance lever 71 and its associated members. These members are omitted in FIGS. 7, 8, 11 and 12 for convenience sake.

Figure 1:
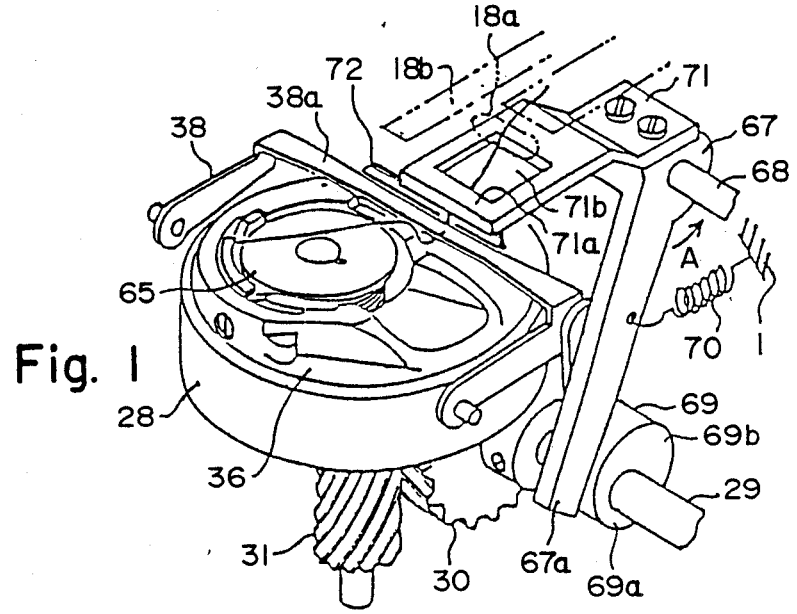
FIG. 1 is an elevated view showing in particular the lower thread supplying mechanism embodying the invention.
Figure 2:
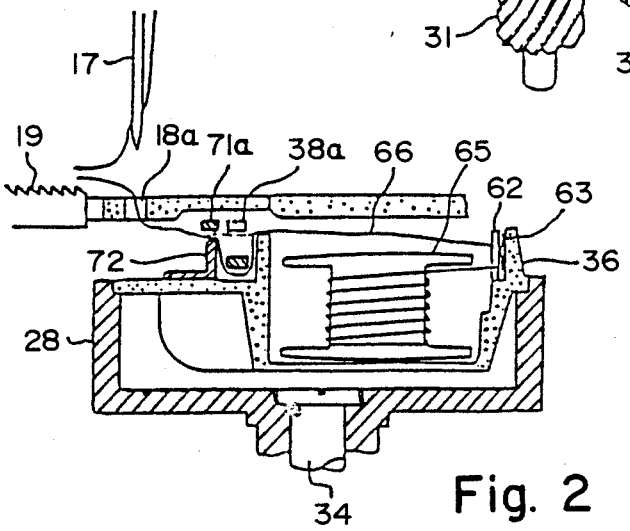
FIG. 2 through FIG. 6 are cross sections of the supplying mechanism of FIG. 1 for demonstrating the operation of the supplying mechanism in sequential order.

In FIG. 1 and FIG. 2, a rotating arm 67 is rotatably supported by a shaft 68 extending in parallel with the lower drive shaft 29. The arm 67 projects in a radial direction to form an end portion 67*a* adapted to be always in contact with a cam 69 secured to the lower drive shaft 29. A spring 70 is connected between the machine housing 1 and the arm 67 to urge the latter to rotate in a direction A. One end of the lever 71 is secured to the pivot end of the arm 67 and other end is provided with a lower thread presser 71*a*. The lower thread presser 71*a* is adapted to be in contact with the top of the partition wall 72 for preventing that the lower thread 66 passing therethrough would be drawn back toward the bobbin 66. A resilient member (not shown) may be attached over the lower face of the presser 71*a* for improving such operation as well as for arresting a knocking sound that may arise when the presser 71*a* strikes the partition wall 72. An opening 71*b* is formed around the lower thread presser 71*b* for allowing the lower thread 66 to pass therethrough toward the needle hole 18*a*.

Figure 3:
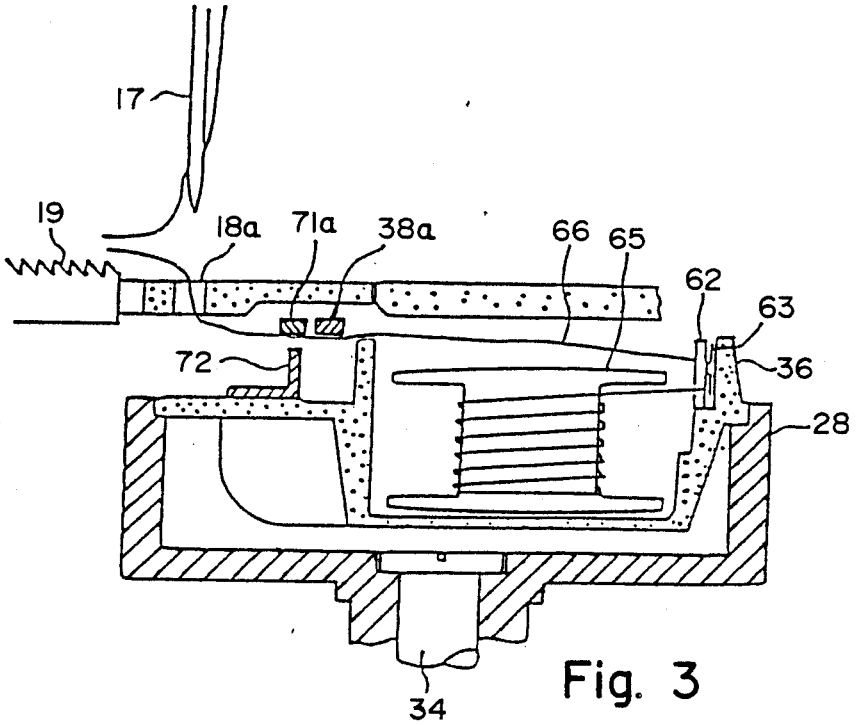

The lower thread presser 71*b* will be cooperated with the center bar section 38*a* of the lever 38. Their position at a time when the main drive shaft 2 has the rotational angle 0° is shown in FIG. 3. As well as the position of the center bar section 38*a* which is also shown in FIG. 12, the lower thread presser 71*b* is retracted above the partition wall 72 because the end portion 67*a* of the arm 67 lies on the largest-diameter portion 69*b* of the cam 69. Consequently, the lower thread 66 can be supplied from the bobbin 65, without interruption, as the fabric is fed by means of the feed dog 19.

Figure 4:
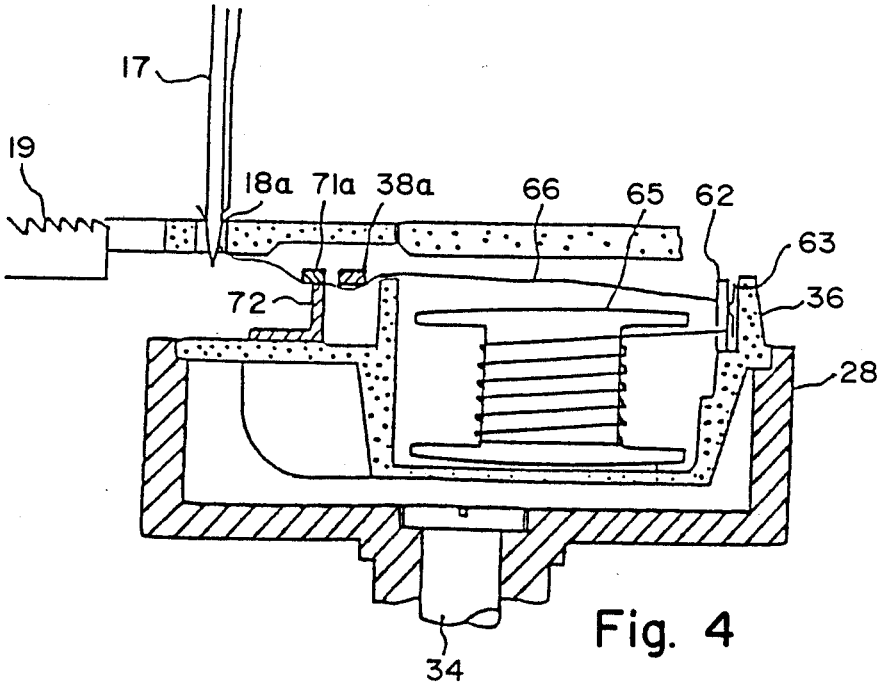
Figure 19:
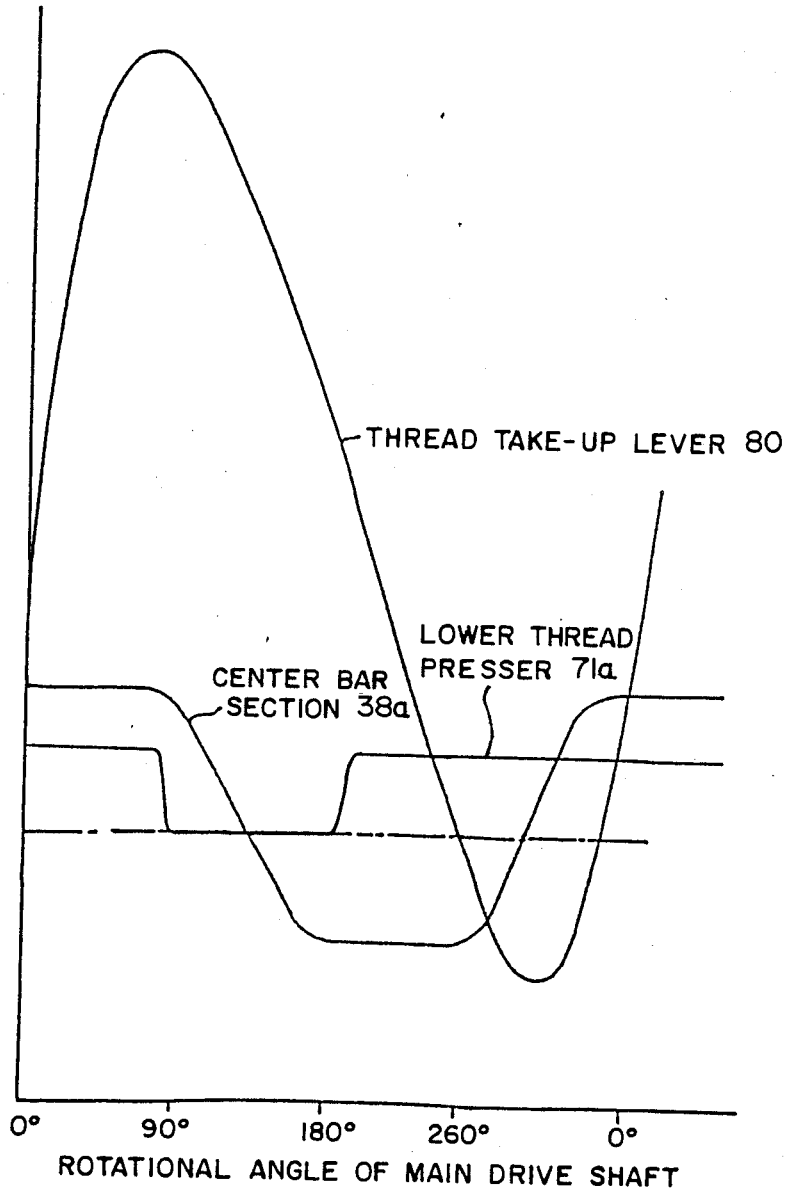
FIG. 19 is a view showing operation of the lower thread drawing means and the lower thread arresting means of the invention, along with movement of a thread take-up lever.

The fabric is being fed during the main drive shaft's position of about 280° to 80°. After the fabric has been fed in a predetermined amount, the lower thread presser 71*a* starts descending, and at about the rotational angle 90° of the main drive shaft 2, it comes in contact with the top edge of the partition wall 72 while the lower thread 66 is being put therebetween, as illustrated in FIG. 4. This lower extreme position of the lower thread presser 71*a* will be maintained during the rotational angle 90° to 180° of the main drive shaft 2, as can be seen in FIG. 19. In FIG. 4, the center bar section 38*a* is on the way to descend and positioned substantially in slight contact with the lower thread 66.

Figure 5:
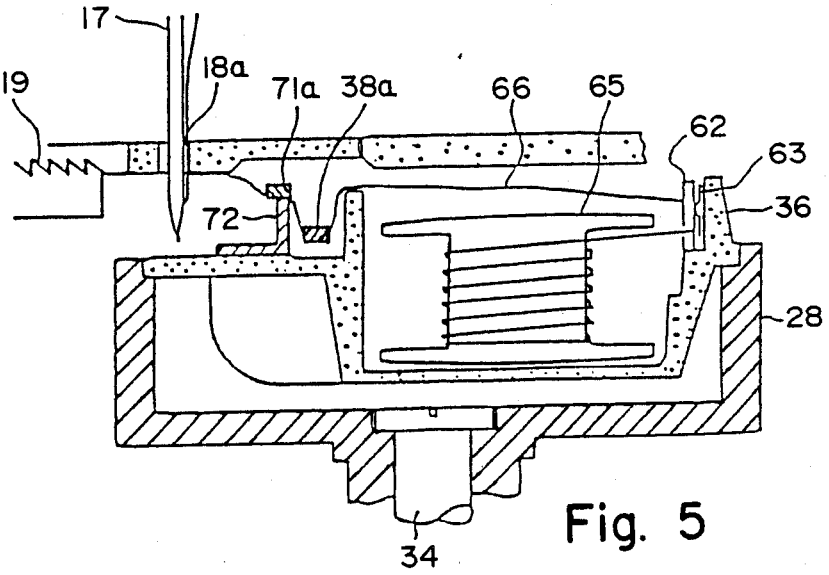
Figure 6:
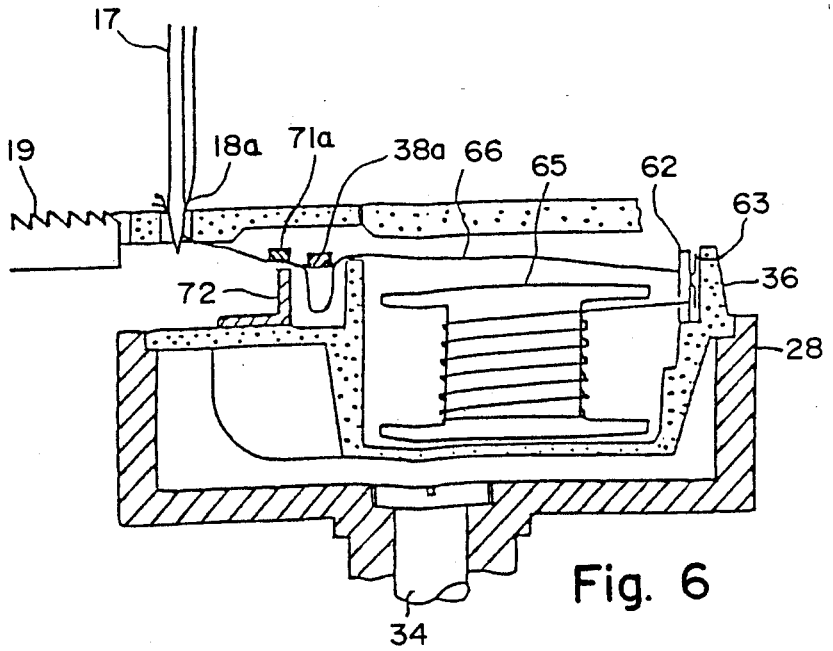
Figure 17:
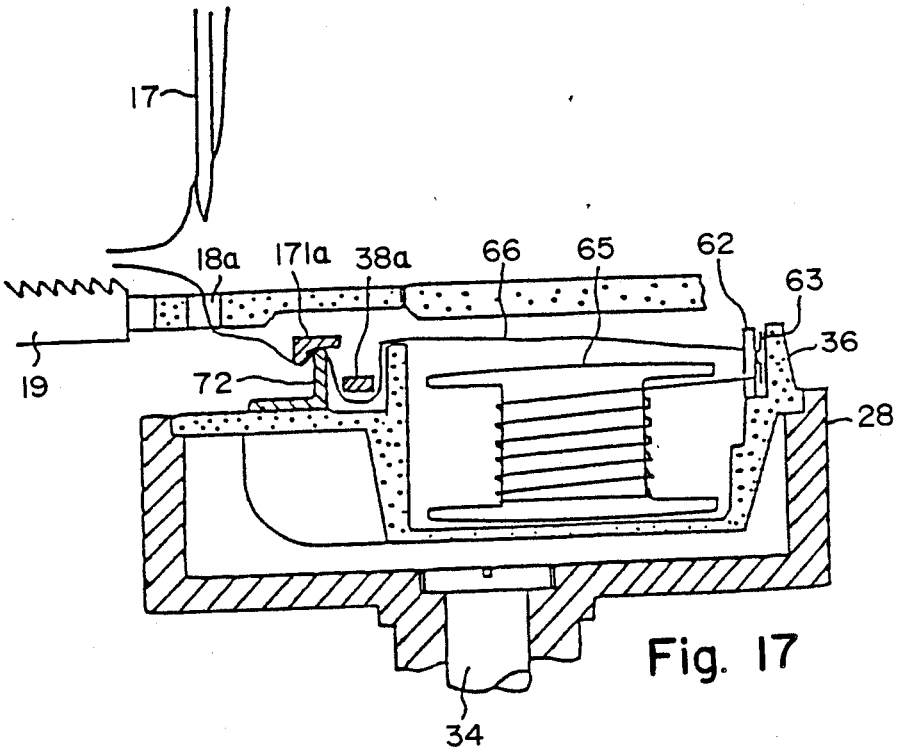
FIG. 17 is a cross section showing another embodiment of the invention.

The center bar section 38*a* continues to descend until the rotational angle of 180°, at which time it takes the lowermost position as shown in FIGS. 5 and 17 so that a predetermined amount of the lower thread 66 has been pulled out of the bobbin 65 against the biasing force exerted by the tension spring 63.

The needle 17 is then turned to ascend toward the 270°, the lower thread presser 71*a* has been returned to the uppermost, remote position while the center bar section 38*a* is on the way to ascend. An amount of the lower thread 66 which has been pulled out of the bobbin 65 is loosened and remains in a grooved path between the bobbin wall 36 and the partition wall 72, which may be supplied for the subsequent stitching operation while the fabric is being fed from the rotational angle of about 280° . The cyclic movement of the lower thread pressser 71*a* is also shown in FIG. 19.

In FIG. 19 a cyclic movement of a thread take-up C. lever 80 (FIG. 13) is also shown. As known, the upper thread is drawn by the thread take-up lever 80 during 7 the ascending movement which starts at about 320° of the rotational angle of the main drive shaft 2 and ends at about 80°, while it is loosened during the descending movement of the thread take-up lever 80. The center bar section 38*a* is lowered during the descending movement of the thread take-up lever 80 so that the lower thread 66 is drawn from the bobbin 65 when the upper thread is loosened.

Figure 15:
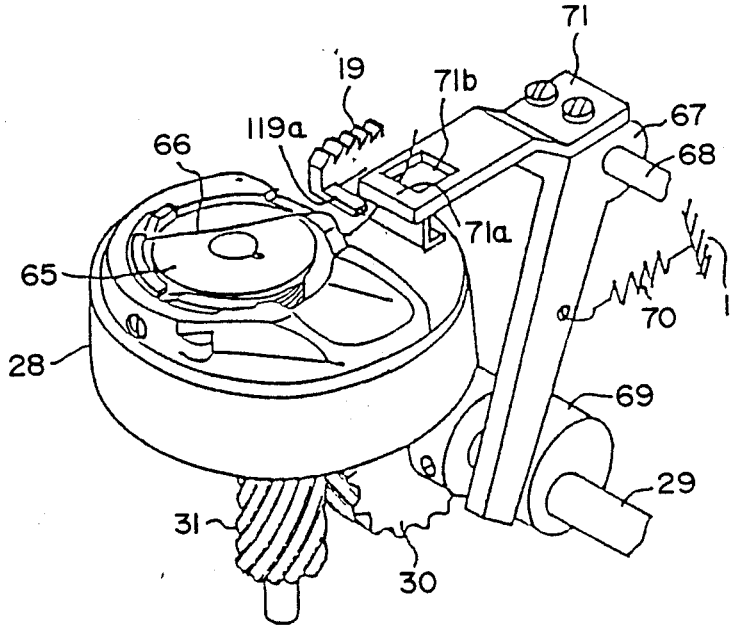
FIG. 15 is an elevated view showing a modified example of the lower thread drawing means.
Figure 16:
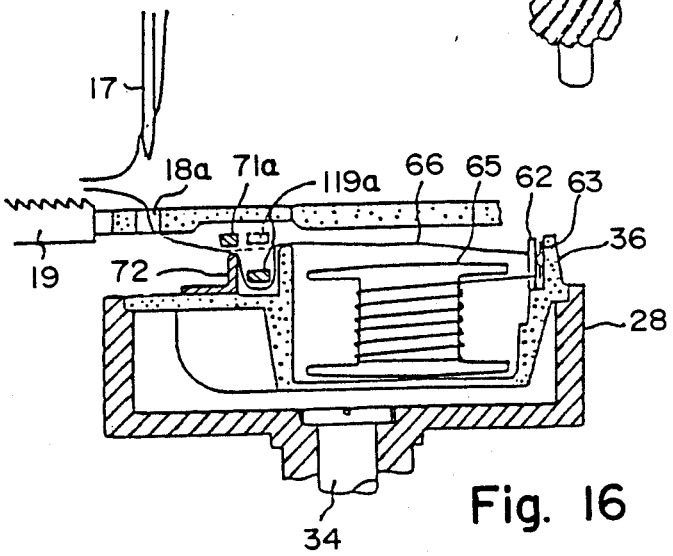
FIG. 16 is a cross section showing the modified example of FIG. 15.

FIG. 15 and 16 illustrate a simplified arrangement for drawing the lower thread. In this arrangement, a bridge bar 119*a* secured to the feed dog 19 is moved along with the feed dog 19 so that the lower thread 66 is drawn from the bobbin 65 while the feed dog 19 is retracted below the needle plate 18. The lower thread presser 71*a* may be cooperated with this simplified arrangement 119.

Figure 18:
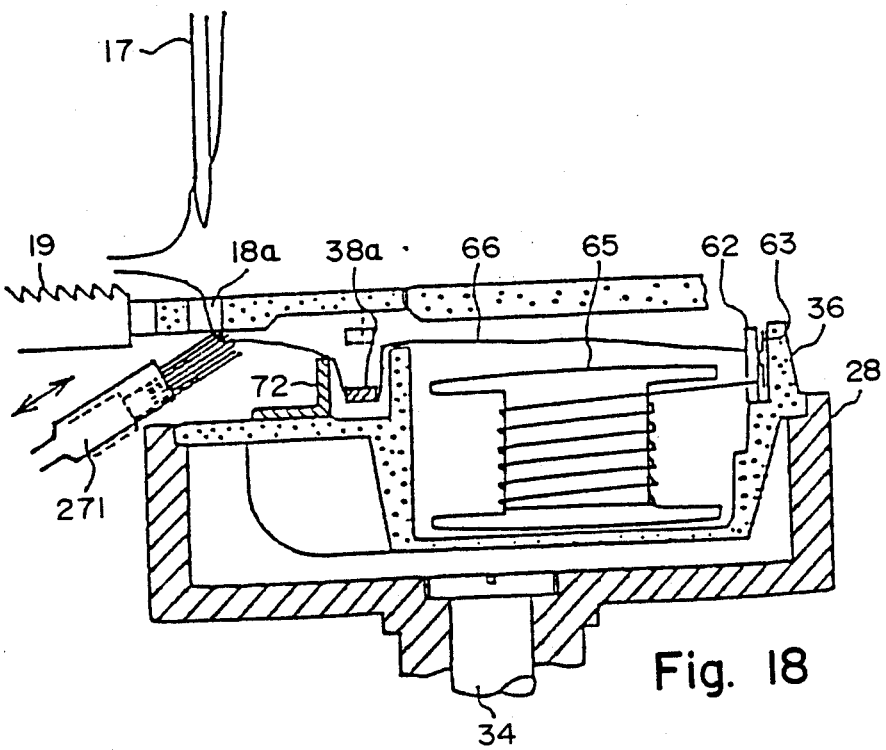
FIG. 18 is a cross section showing still another embodiment of the invention.

Although the invention has been described in conjunction with specific embodiments thereof, it is to be understood that many variations and modifications may be made without departing from spirit and scope of the invention as defined in the appended claims. For example, the spring-biased lower thread presser 71*a* may be replaced by a member 171*a* having a substantially L-shaped cross-section as shown in FIG. 17. Another embodiment is shown in FIG. 18 which comprises a brushlike member 271 adapted to be protruded into the lower thread path for preventing the lower thread 66 from being pulled back from the stitch when it is pulled out of the bobbin 65. The brush-like member 271 is moved as shown by the arrow in synchronism with movement of the center bar section 38*a*. In FIGS. 15 through 18, members and components which will be identical to those shown in the principal embodiment are accompanied by the same reference numerals.

What is claimed is:

1. In a sewing machine having a vertically reciprocating needle carrying an upper thread, a needle plate secured to a sewing machine housing and provided with a needle penetrating hole, a loop-taker means arranged below the needle plate and operated in synchronism with reciprocation of the needle for interlocking a lower thread carried thereby with the upper thread, and a fabric feeding means for feeding a fabric placed on the needle plate in a predetermined direction on which a stitch composed of the interlocked upper and lower threads has been formed, a lower thread supplying mechanism comprising a lower thread drawing means for drawing a predetermined amount of the lower thread out of said loop-taker means, and a lower thread arresting means cooperating with said lower thread drawing means for preventing the lower thread from being pulled back from the stitch formed on the fabric while the lower thread is being drawn out of said loop-taker means by said lower thread drawing means.

2. The lower thread supplying mechanism according to claim 1 wherein said lower thread arresting means comprises a bar-like member extending substantially perpendicular to a lower thread travelling path between said lower thread drawing means and said needle penetrating hole, and a partition wall secured to said loop-taker means cooperating with said bar-like member to interpose the lower thread therebetween.

3. The lower thread supplying mechanism according to claim 2 wherein said bar-like member is moveable in a vertical direction through a cam arrangement operated in syncronism with a main drive shaft for driving the needle, said bar-like member is spring-biased to move down to be in contact under pressure with said partition wall.

4. The lower thread supplying mechanism according to claim 2 wherein said bar-like member and said partition wall are adapted to be in resilient contact with each other to provide for frictional resistance to the lower thread.

5. The lower thread supplying mechanism according to claim 2 wherein said bar-like member extends downwardly on a side opposite to said lower thread drawing means, to have substantially a L shape cross-section.

6. The lower thread supplying mechanism according to claim 1 wherein said lower thread arresting means comprises a brush-like member adapted to protrude into a lower thread travelling path between said lower thread drawing means and said needle plate.

7. The lower thread supplying mechanism according to claim 1 further comprising a means for rendering said lower thread drawing means inoperative while the fabric is being fed by said fabric feeding means.

8. The lower thread supplying mechanism according to claim 1 further comprising a means for rendering said lower thread drawing means operative while the upper thread is loosened.

* * * * *